US007950322B2

(12) United States Patent
Vicars

(10) Patent No.: US 7,950,322 B2
(45) Date of Patent: May 31, 2011

(54) PLUNGER ASSEMBLY

(76) Inventor: Berton L. Vicars, Ruidoso, NM (US)

( * ) Notice: Subject to any disclaimer, the term of this patent is extended or adjusted under 35 U.S.C. 154(b) by 44 days.

(21) Appl. No.: 12/588,269

(22) Filed: Oct. 9, 2009

(65) Prior Publication Data

US 2011/0083552 A1 Apr. 14, 2011

(51) Int. Cl.
*F01B 29/08* (2006.01)
*F16J 1/10* (2006.01)

(52) U.S. Cl. ..... 92/128; 92/255

(58) Field of Classification Search ..... 92/128, 92/145, 187, 255
See application file for complete search history.

(56) References Cited

U.S. PATENT DOCUMENTS 3,376,826 A 4/1968 Crowe
3,776,558 A 12/1973 Maurer et al.
4,249,831 A 2/1981 Sable et al.
4,758,135 A 7/1988 Woodward et al.
6,382,940 B1 * 5/2002 Blume ..... 417/571
2004/0234404 A1 * 11/2004 Vicars ..... 417/571
* cited by examiner

*Primary Examiner* — Michael Leslie
(74) *Attorney, Agent, or Firm* — Stephen R. Greiner

(57) ABSTRACT

A plunger assembly including a pony rod adapter, a plunger releasably attached to the pony rod adapter, and a pony rod being releasably attached to the pony rod adapter. The pony rod adapter has a first cylindrical body and a number of apertures penetrating the first cylindrical body for receiving a lever. A first helically threaded pin is affixed to the first cylindrical body and projects from one of its ends. A second helically threaded pin is affixed to the first cylindrical body and projects from the other of its ends. The plunger has a second cylindrical body for reciprocating within a pumping chamber. The second cylindrical body has a first outer end with a first helically threaded bore for threadably receiving the first helically threaded pin. The second cylindrical body also has a first inner end with a polygonal socket for receiving a plunger key. The pony rod has a third cylindrical body for reciprocating into, and out of, the power end of a pump. The third cylindrical body has a second inner end with a second helically threaded bore for threadably receiving the second helically threaded pin. The third cylindrical body also has a second outer end. A peripheral flange is affixed to, and extends outwardly from, the second outer end. The peripheral flange is provided with a number of holes through which an equal number of threaded fasteners are extended for connecting the pony rod to the power end of a pump.

8 Claims, 5 Drawing Sheets

PLUNGER ASSEMBLY

FIELD OF THE INVENTION

The present invention relates to expansible chamber devices and, more particularly, to pistons having plural separable parts.

BACKGROUND OF THE INVENTION

Hydraulic fracturing can increase the rate of production of oil and gas from low-permeability reservoirs. Hydraulic fracturing increases the permeability of reservoir rocks by opening channels through which oil and gas can move. During a hydraulic fracturing procedure, a fluid is pumped through a wellbore under high pressure into a subterranean reservoir where it splits or fractures the reservoir rock. A proppant, like sand, is often added to the pumped fluid and is carried in suspension into the newly formed fractures. When pumping ceases, the fractures partially close on the proppant, leaving channels for oil and gas to flow to a recovery well.

High-pressure pumps are used to complete hydraulic fracturing procedures or "frac jobs." These pumps have plungers that reciprocate within a pumping chamber to produce the extremely high pressures necessary break reservoir rocks underground. As the plungers reciprocate within the pumping chamber, the plungers cycle between high and low pressures and are subjected to high stress variations. The plungers also rub against sealing elements in the ends of the pumping chambers and, consequently, are worn and abraded by proppants and other materials carried in the pumped fluids.

Oilfield equipment manufacturers have made few provisions in their pumps for fixing pump plungers as they wear out. Typically, the plungers are located deep within a fluid end of a pump that is held together by a large number of heavy, threaded fasteners. To access the worn plungers, the fluid end and other pump components must often be disassembled. Although manufacturers provide strong and robust pumps, disassembly of pumps in the field is especially time-consuming and difficult to perform.

SUMMARY OF THE INVENTION

In light of the problems associated with the known pump plungers, it is a principal object of mine to provide a new, plunger assembly that is quick and easy to access in a pump and which has field-replaceable components that prolong pump life, reduce costs, and optimize profits. Workers with minimal training can accomplish the installation of my plunger assembly with simple, hand tools and without the need to remove the fluid end of a pump from the power end. Certainly, complete pump disassembly is not required for installation of my assembly.

It is a further object of mine to provide a plunger assembly of the type described that is simple in construction as well as very efficient and reliable in operation. My plunger assembly is constructed from a limited number of high-strength components that permit a pump to achieve high pumping rates at high working pressures.

It is an object of the invention to provide improved features and arrangements thereof in a plunger assembly for the purposes described which is lightweight in construction and inexpensive to manufacture.

The foregoing and other objects, features and advantages of my plunger assembly will become readily apparent upon further review of the following detailed description of the preferred embodiments as illustrated in the accompanying drawings.

BRIEF DESCRIPTION OF THE DRAWINGS

My plunger assembly can be more readily described with reference to the accompanying drawings, in which.

Similar reference characters denote corresponding features consistently throughout the accompanying drawings.

DETAILED DESCRIPTION OF THE INVENTION

Figure 1:
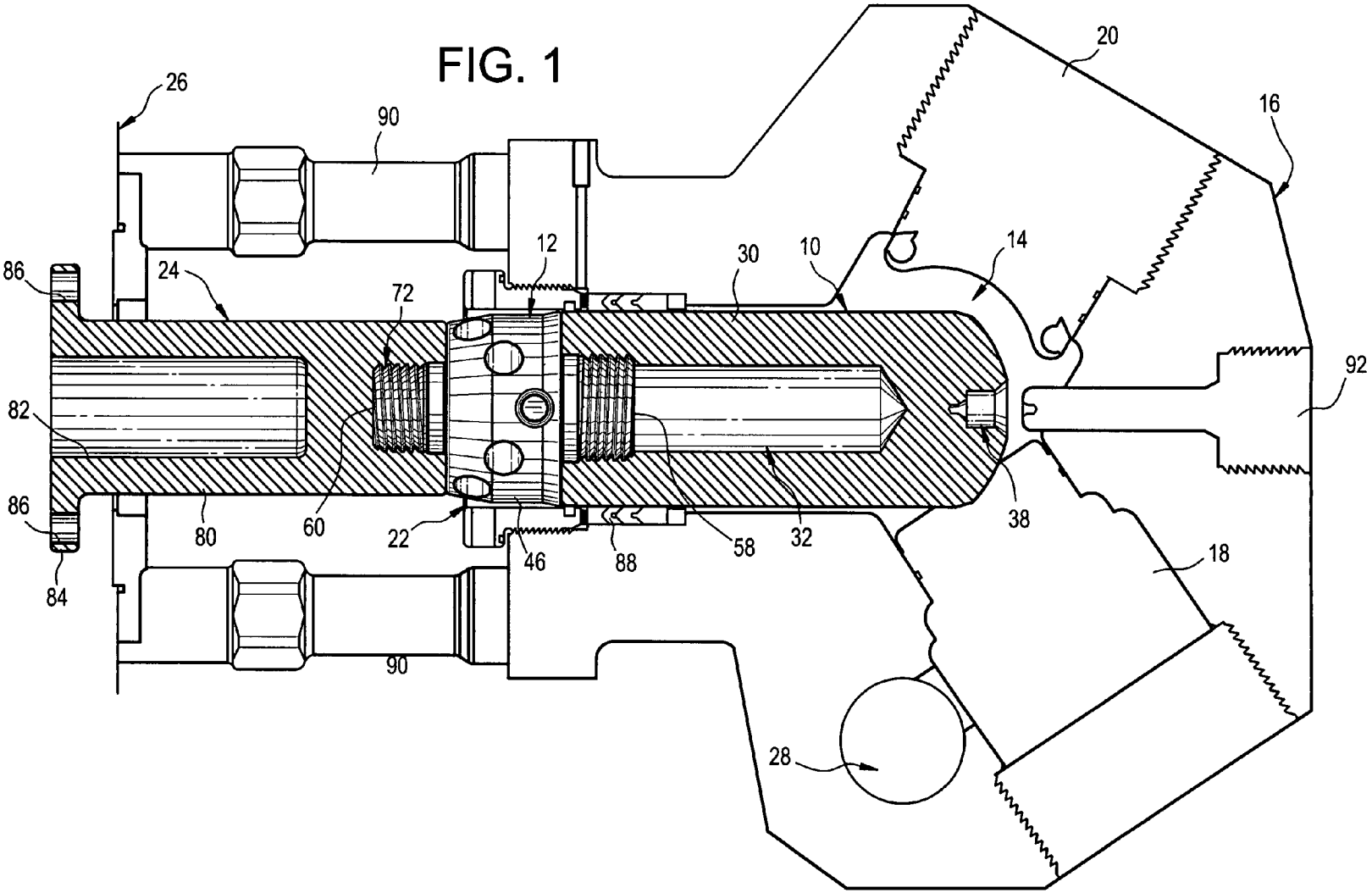
FIG. 1 is a longitudinal, cross-sectional view of a fluid end of a pump within which is positioned a plunger assembly constructed in accordance with the present invention.

Referring now to the FIG. 1, a plunger 10 with a pony rod adapter 12 are shown to be positioned within the pumping chamber 14 of a fluid end 16. Fluid is drawn into chamber 14 at low pressure through a suction valve 20 and is pushed from chamber 14 via a discharge valve 18 at high pressure. The pressurization of the fluid within chamber 14 is caused by the movement of plunger 10 into, and out of, the open end 22 of chamber 14 as directed by a pony rod 24 that projects from the power end 26 of the pump of which fluid end 16 is a part. Pony rod 24 is connected to plunger 10 by means of adapter 12 and is reciprocated by a drive mechanism (not shown) located within the power end 26.

As plunger 10 is moved into chamber 14, the fluid pressure within chamber 14 is increased. At a predetermined point, the fluid pressure is sufficient to open discharge valve 18 to release fluid from chamber 14 and into discharge passage 28 from which fluid flows from fluid end 16 at high pressure to perform work. The amount of pressure needed to open discharge valve 18 may be determined by a spring that keeps discharge valve 18 closed until the threshold pressure is achieved in chamber 14.

Plunger 10 also creates low-pressure conditions in chamber 14. When plunger 10 is withdrawn from its forwardmost position in chamber 14, the fluid pressure therein decreases. As the pressure within the chamber 14 decreases, discharge valve 18 closes, sealing chamber 14. Then, as plunger 10 continues to move out of chamber 14, the fluid pressure therein continues to drop to a point sufficient to open suction valve 20. The opening of suction valve 20 allows fluid to flow into chamber 14. The amount of pressure required to open suction valve 20 may be determined by a spring that keeps suction valve 20 closed until the requisite low pressure is achieved in chamber 14.

Plunger 10 includes an elongated, cylindrical body 30 adapted for reciprocation within chamber 14. An enlarged bore 32 is provided in the outer end of body 30. Bore 32 has a helically threaded, outer portion 34 for threaded engagement with adapter 12 and a non-threaded, inner portion 36 for reducing the reciprocating weight of plunger 10. A socket 38 is provided in the convex, inner end of body 30 and is axially aligned with bore 32 at the center of body 30. Socket 38 has a tapered, outer part 40 for guiding a plunger key (like an enlarged Allen key, not shown) into a correspondingly shaped, medial part 42 of square outline. Medial part 42 opens into a conical, inner part 44 for aligning the tapered tip of a plunger key in socket 38.

Although medial part 42 of socket 38 is shown to have a square, polygonal outline, it can have any desired outline. That outline, however, must correspond in terms of shape and size to that of the plunger key so that plunger 10 can be prevented from rotating when adapter 12 is turned for assembly or disassembly as described below.

Pony rod adapter 12 includes a cylindrical body 46 having planar, abutment surfaces 48 and 50 at its opposite ends for snug engagement with plunger 10 and pony rod 24, respectively. Between surfaces 48 and 50, body 46 is penetrated by a number of apertures 52, 54 and 56 spaced around the perimeter thereof, like the hour indicators on the dial of a clock, for selectively receiving a lever (not shown) for turning adapter 12 during installation of the plunger assembly. A threaded pin 58 projects from the center of abutment surface 48 at the inner end of body 46 for releasably fastening adapter 12 to plunger 10. Another threaded pin 60 projects from the center of abutment surface 50 at the outer end of body 46 for releasably fastening adapter 12 to pony rod 24.

Body 46 has three segments 62, 64 and 66 with middle segment 62 joining inner segment 64 to outer segment 66. As shown, middle segment 62 has a constant outer diameter along its length. Inner segment 64, however, has a diameter that increases evenly from its outer end proximate pony rod 24 to its inner end where it joins with middle segment 62. Outer segment 66 is similarly provided with a diameter that increases evenly from its outer end where it joins middle segment 62 to its inner end proximate plunger 10. Body 46, therefore, tapers, in stair step fashion, from its inner end to its outer end so as to evenly distribute loads between plunger 10 and pony rod 24 having a relatively smaller diameter.

Apertures 52 are provided in the outer segment 66 of body 46. Apertures 52 are provided in opposed pairs on inclined axes $A_1$ that intersect one another at the center of body 46. Axes $A_1$ incline at an angle A of 30° to a vertical line $V_1$ that also passes through the center of body 46.

Figure 5:
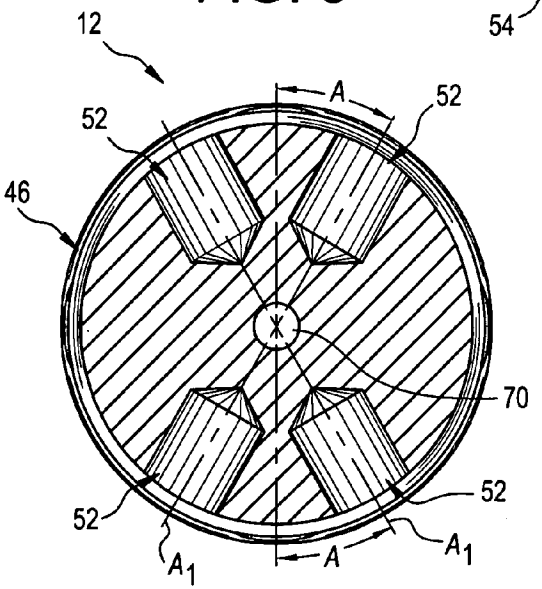
FIG. 5 is a cross-sectional view taken along line 5-5 of FIG. 2.
Figure 8:
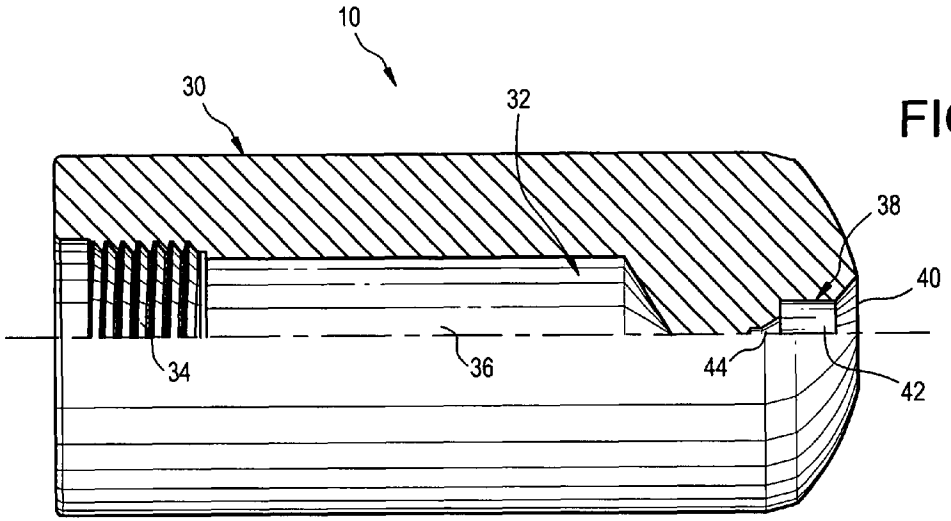
FIG. 8 is a side elevational view of the plunger of my plunger assembly with portions broken away to reveal details thereof.

Apertures 56 extend through both the middle segment 62 and the inner segment 64 of body 46. Apertures 56 are provided in opposed pairs on axes $A_2$ and $A_3$ that intersect one another at the center of body 46. Axes $A_2$ and $A_3$ are oriented at right angles to one another with axis $A_2$ corresponding in position to vertical line $V_1$ of FIG. 5. One of apertures 56 on axis $A_3$ has a small-diameter, inner portion 68 that extends to the center of body 52 where it intersects with a longitudinal bore 70 that extends from the inner end of adapter 12 to the outer end thereof, fully through body 46 and pins 58 and 60. Inner portion 68 and the associated bore 56 serve to relieve the build-up of air pressure when adapter 12 is being connected to plunger 10 and pony rod 24.

Apertures 54 are positioned midway between apertures 52 and apertures 56 to maximize the strength of body 46. Apertures 54 extend through both the outer segment 66 and the middle segment 62 of body 46. Apertures 54 are provided in opposed pairs on inclined axes $A_4$ that intersect one another at the center of body 46. Axes $A_4$ incline at an angle A of 60° to a vertical line $V_2$ that passes through the center of body 46.

Threaded pins 58 and 60 have helical threads that can be screwed, respectively, into tight engagement with threaded bore 34 in plunger 10 and a threaded bore 72 provided in the inner end of pony rod 24. The helical threads on pins 58 and 60 are the same size, but their configurations are mirror images. Thus, pin 58 has right-handed threads and pin 60 has left-handed threads that permit adapter 12 to be simultaneously engaged to, or disengaged from, plunger 10 and pony rod 24. This double-action feature makes it a snap to replace a plunger 10 in the event that it becomes worn during use.

Body 46 is provided with three holes 74 that penetrate abutment surface 50. Holes 74 are evenly spaced from one another around threaded pin 60 at 120° intervals. Also, holes 74 have a depth that is substantially equal to their diameter.

Body 46 is provided with three holes 76 that penetrate abutment surface 48. Holes 76 are evenly spaced from one another around threaded pin 58 at 120° intervals. (These intervals are 60° out of phase with those associated with holes 74.) Also, holes 76 have a depth that is substantially equal to their diameter.

Figure 2:
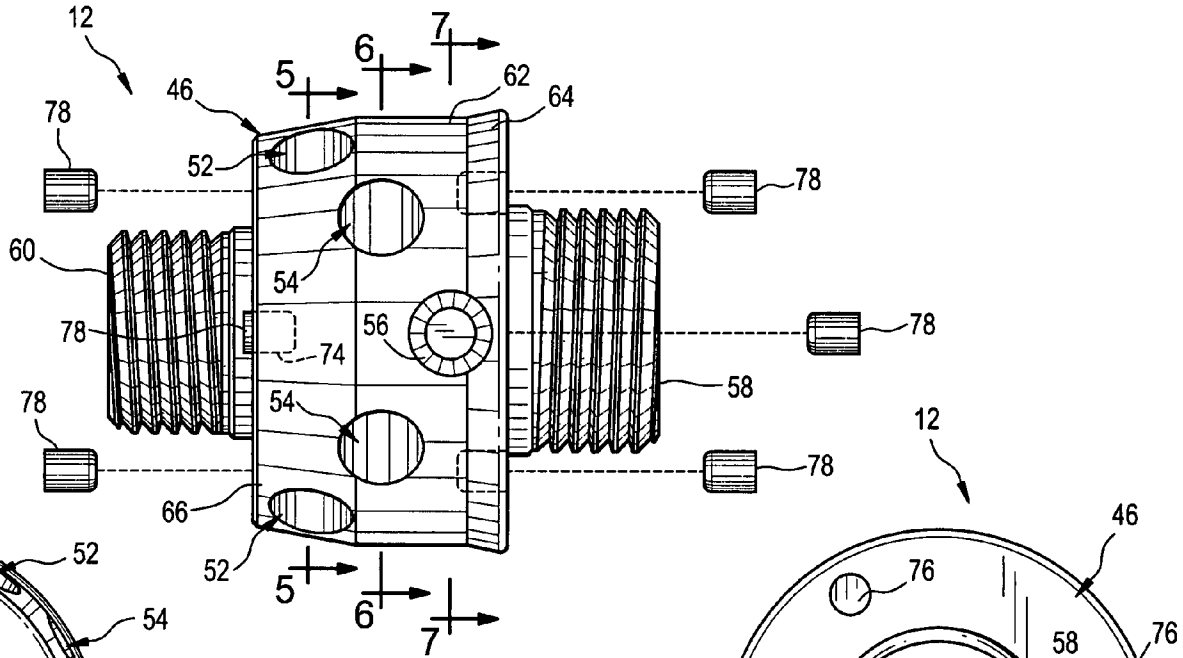
FIG. 2 is an exploded, side elevational view of the pony rod adapter of my plunger assembly.
Figure 4:
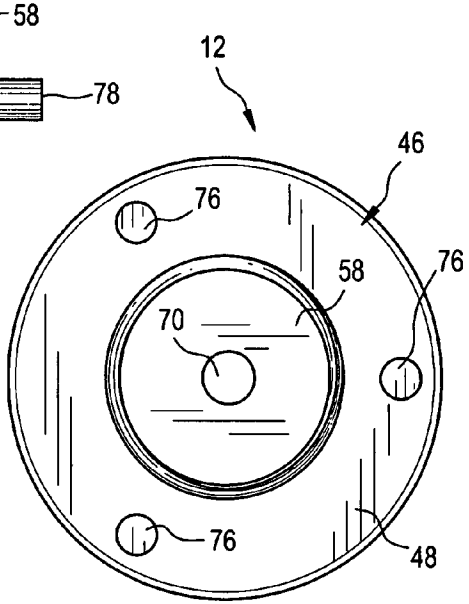
FIG. 4 is a top view of the pony rod adapter of FIG. 2.
Figure 3:
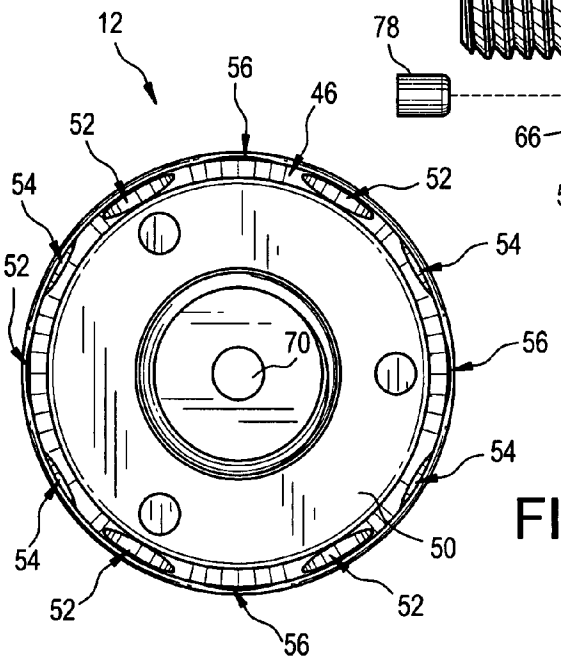
FIG. 3 is a bottom view of the pony rod adapter of FIG. 2.
Figure 6:
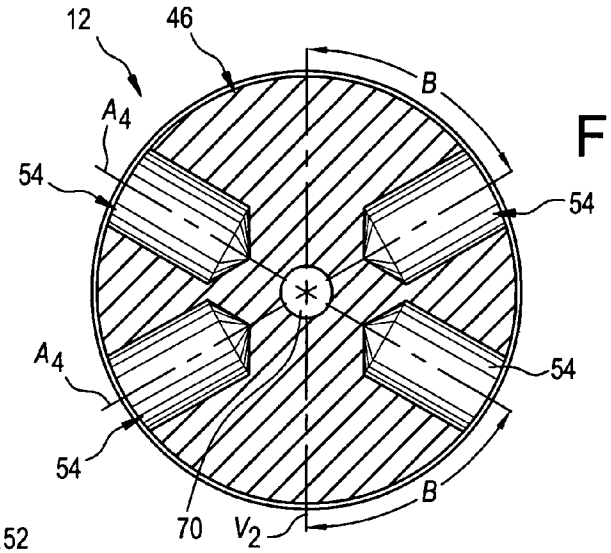
FIG. 6 is a cross-sectional view taken along line 6-6 of FIG. 2.
Figure 7:
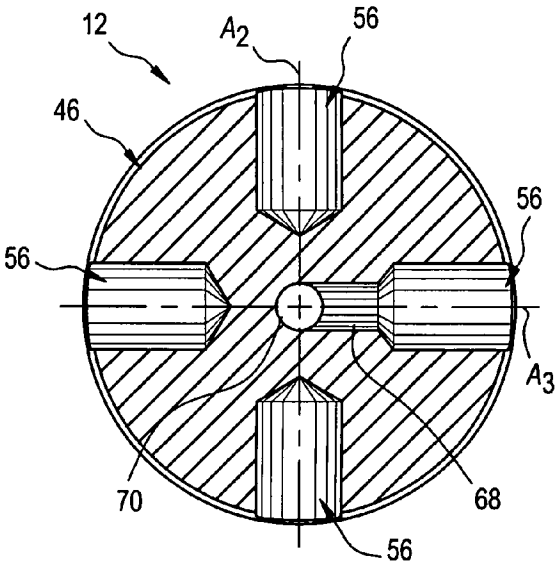
FIG. 7 is a cross-sectional view taken along line 7-7 of FIG. 2.

One of a number of locking pins 78 is snugly fitted in each of holes 74 and 76. Each of locking pins 78 is formed of nylon and projects slightly from its associated hole 74 or 76 when initially inserted therein as shown in FIG. 2. When adapter 12 is fully rotated into threaded engagement with plunger 10 and pony rod 24, the outward projections of pins 78 are crushed, flattened and compressed into positions even with abutment surfaces 48 and 50. In a compressed state, pins 78 exert outward pressure on the outer end of plunger 10 and the inner end of pony rod 24 thereby inhibiting their unintended rotation, locking adapter 12 to plunger 10 and pony rod 24.

Pony rod 24 includes an elongated, cylindrical body 80 adapted for reciprocation into, and out of, power end 26. A helically threaded bore 72 is provided in the inner end of body 80 for threaded engagement with adapter 12. An enlarged bore 82 is provided in the outer end of body 80 for reducing the reciprocating weight of pony rod 24. A peripheral flange 84 extends outwardly from the outer end of body 80 and is integrally formed with body 80. Flange 84 is provided with a number of holes 86 through which threaded fasteners (not shown) are extended to connect pony rod 24 to the drive mechanism within power end 26.

As was noted above, the reciprocating motion of plunger 10 within pumping chamber 14 controls the fluid pressure therein. Suction valve 20 and discharge valve 18 respond accordingly to dispense pressurized fluid from chamber 14, and eventually out of fluid end 16, at high pressure. The discharged fluid is, then, replaced with fluid from suction valve 20. Repeated motion of plunger 10 against packing elements 88 that seal the open end 22 of chamber 14 often causes plunger 10 to wear to the point where its replacement is necessary.

To replace plunger 10, the user must perform a few simple steps. First, the power end 26 of the pump is deenergized and, by suitable movement of the drive mechanism, adapter 12 is positioned between the stay rods 90 that connect the power end 26 to the fluid end 16. With adapter 12 preferably located as close to power end 26 as possible (requiring leftward movement of adapter 12 from its starting position shown in FIG. 1), a lever is inserted into a suitable one of apertures 52, 54 or 56. Now, access plug 92, providing an entryway into chamber 14 and being axially aligned with socket 38, is unscrewed from fluid end 16, and a square-ended, plunger key is inserted through the entryway into socket 38 in plunger 10. Next, while holding the plunger key as still as possible, adapter 12 is rotated by means of the lever so as to simultaneously unscrew adapter 12 from both plunger 10 and pony rod 24. Then, by suitable manipulation, adapter 12 and plunger 10 are removed from fluid end 16. By substituting a new plunger 10 for the old one and reversing the process steps noted above, the new plunger 10 is made ready for operation in fluid end 16. The entire event requires just a few minutes to complete.

It should be noted that although one plunger 10 is shown in the FIGS., in embodiments where fluid end 16 has a triplex arrangement, the associated pump has three plungers 10 with the same or similar configurations. Similarly, with a quintiplex arrangement, there are four plungers 10. So, the number of plungers 10 employed in a pump is variable as is the amount of time required for replacing the worn plungers 10 of a pump. Regardless, the time required is far less than has been possible with any known plunger designs.

Figure 10:
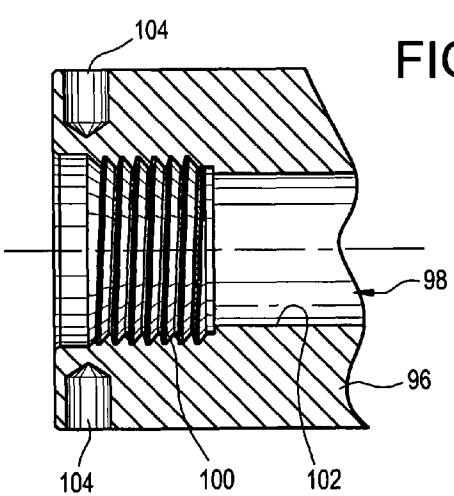
FIG. 10 is a cross-sectional view of an alternate plunger for use in my plunger assembly with portions broken away.
Figure 9:
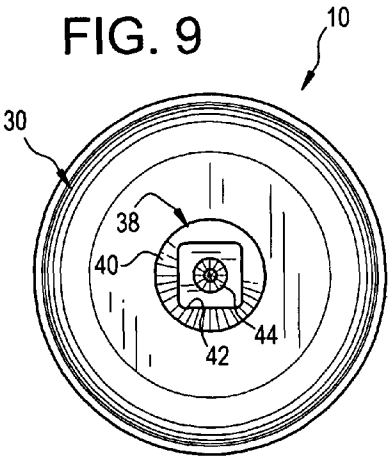
FIG. 9 is a top view of the plunger of FIG. 8.
Figure 12:
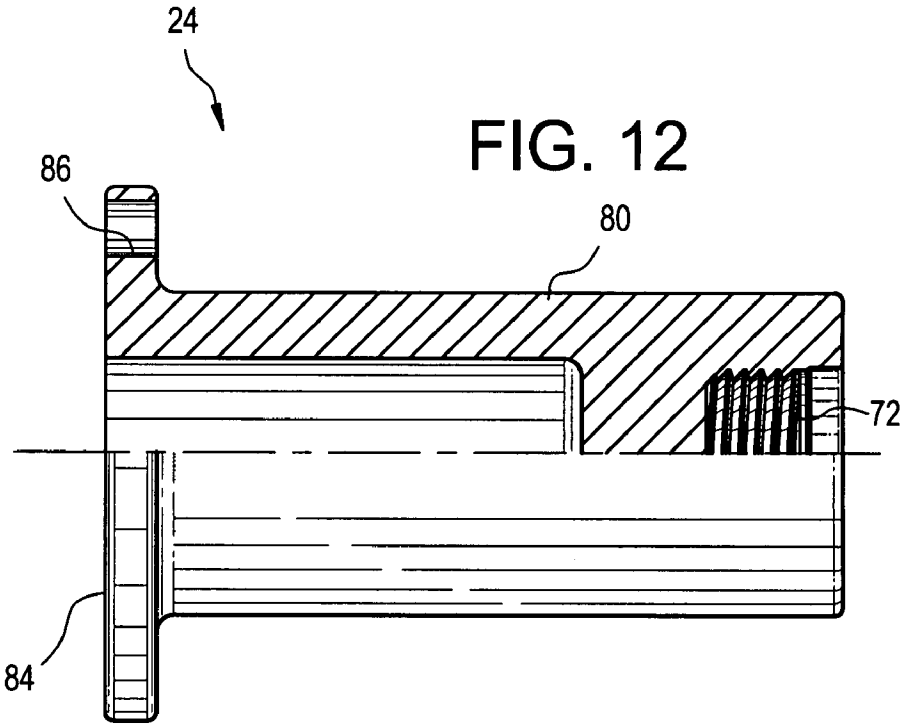
FIG. 12 is a side elevational view of the pony rod with portions broken away.
Figure 11:
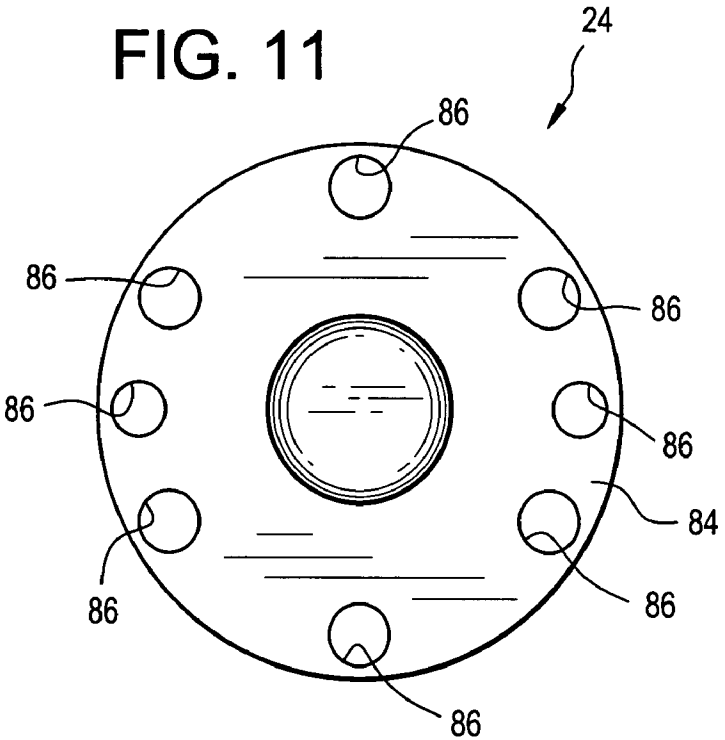
FIG. 11 is an outer end view of the pony rod of my plunger assembly.

While plunger 10, pony rod adapter 12, and pony rod 24, comprising my plunger assembly, have been described in great detail, it will be appreciated by individuals having knowledge of plunger-type pumps that modifications can be made to plunger 10, adapter 12, and pony rod 24. For example, FIG. 10 shows an alternate plunger 94. Plunger 94 has an elongated, cylindrical body 96 adapted for reciprocation within chamber 14. An enlarged bore 98 is provided in the outer end of body 96. Bore 98 has a helically threaded, outer portion 100 for threaded engagement with adapter 12 and a non-threaded, inner portion 102 for reducing the reciprocating weight of body 96. Plunger 94 has no socket like the one shown at 38, but rather is provided with twelve, radial holes 104 penetrating body 96 around outer portion 100. Holes 104 permit plunger 94 to be grasped by a spanner wrench (not shown) extended between stay rods as shown at 90 during the installation or removal of plunger 94. Therefore, it must be understood that my invention is not limited solely to plunger 10 and adapter 12, but encompasses any, and all, plungers and pony rod adapters within the scope of the following claims.

I claim:

1. A plunger assembly, comprising:

a pony rod adapter including:

a first cylindrical body having opposite ends and a plurality of apertures penetrating said first cylindrical body between said opposite ends for receiving a lever;

a first helically threaded pin being affixed to said first cylindrical body and projecting from one of said opposite ends; and, a second helically threaded pin being affixed to said first cylindrical body and projecting from the other one of said opposite ends;

a plunger being releasably attached to said pony rod adapter, said plunger including:

a second cylindrical body for reciprocating within a pumping chamber, said second cylindrical body having a first outer end with a first helically threaded bore for threadably receiving said first helically threaded pin, and said second cylindrical body also having a first inner end remote from said first outer end with a polygonal socket for receiving a plunger key; and, a pony rod being releasably attached to said pony rod adapter, said pony rod including:

a third cylindrical body for reciprocating into, and out of, the power end of a pump, said third cylindrical body having a second inner end with a second helically threaded bore for threadably receiving said second helically threaded pin, and said third cylindrical body also having a second outer end; and, a peripheral flange being affixed to, and extending outwardly from, said second outer end, said peripheral flange being provided with a plurality of holes through which a plurality threaded fasteners are extended for connecting said pony rod to the power end of a pump.

2. The plunger assembly according to claim 1 wherein said first helically threaded pin has first helical threads and said second helically threaded pin has second helical threads, and said first helical threads are opposite in their orientation relative to said second helical threads.

3. The plunger assembly according to claim 1 wherein said first cylindrical body is divided by equally angularly spaced radials projecting outwardly from the center thereof at positions of: 1 o'clock, 2 o'clock, 3 o'clock, 4 o'clock, 5 o'clock, 6, o'clock, 7 o'clock, 8, o'clock, 9 o'clock, 10 o'clock, 11 o'clock, and 12 o'clock, and said plurality of apertures penetrating said first cylindrical body include:

a first pair of apertures penetrating said first cylindrical body on opposed 1 o'clock and 7 o'clock radials;

a second pair of apertures penetrating said first cylindrical body on opposed 5 o'clock and 11 o'clock radials;

a third pair of apertures penetrating said first cylindrical body on opposed 2 o'clock and 8 o'clock radials;

a fourth pair of apertures penetrating said first cylindrical body on opposed 4 o'clock and 10 o'clock radials;

a fifth pair of apertures penetrating said first cylindrical body on opposed 3 o'clock and 9 o'clock radials;

a sixth pair of apertures penetrating said first cylindrical body on opposed 6 o'clock and 12 o'clock radials;

said first pair of apertures and said second pair of apertures being equidistantly spaced from said second outer end;

said third pair of apertures and said fourth pair of apertures being equidistantly spaced from said second outer end, and said third pair of apertures being located further from said second outer end than said first pair of apertures; and, said fifth pair of apertures and said sixth pair of apertures being equidistantly spaced from said second outer end, and said fifth pair of apertures being located further away from said second outer end than said third pair of apertures.

4. The plunger assembly according to claim 1 wherein said first cylindrical body includes:

a middle segment having a constant diameter along the length thereof, said middle segment having a front end and a rear end;

an inner segment being affixed to, and extending from, said front end of said middle segment, said inner segment having a diameter that increases evenly from said front end of said middle segment to a first free end remote therefrom; and, an outer segment being affixed to, and extending from, said rear end of said middle segment, said outer segment having a diameter that decreases evenly from said rear end of said middle segment to a second free end remote therefrom.

5. The plunger assembly according to claim 1 wherein said pony rod adapter is provided with a longitudinal bore extending fully through said first cylindrical body, said first helically threaded pin, and said second helically threaded pin, and wherein one of said apertures is provided with an inner portion that connects to said longitudinal bore for pressure relief purposes.

6. The plunger assembly according to claim 1 wherein one of said opposite ends of said pony rod adapter is provided with a plurality of first holes positioned around said first helically threaded pin and the other one of said opposite ends of said pony rod adapter is provided with a plurality of second holes positioned around said second helically threaded pin and said plunger assembly further comprises:

a plurality of crushable, locking pins with one of said locking pins being positioned in a respective one of said first and second holes in said pony rod adapter.

7. The plunger assembly according to claim 1 wherein said first helically threaded bore in said plunger extends to a point proximate said first inner end of said plunger for reducing the reciprocating weight thereof.

8. A plunger assembly, comprising:

a pony rod adapter including:

a first cylindrical body having opposite ends and a plurality of apertures penetrating said first cylindrical body between said opposite ends for receiving a lever;

a first helically threaded pin being affixed to said first cylindrical body and projecting from one of said opposite ends; and, a second helically threaded pin being affixed to said first cylindrical body and projecting from the other one of said opposite ends;

a plunger being releasably attached to said pony rod adapter, said plunger including:

a second cylindrical body for reciprocating within a pumping chamber, said second cylindrical body having a first outer end with a first helically threaded bore for threadably receiving said first helically threaded pin, said second cylindrical body being provided with a plurality of radial holes in said first outer end thereof for receiving a spanner wrench, and said second cylindrical body also having a first inner end remote from said first outer end; and, a pony rod being releasably attached to said pony rod adapter, said pony rod including:

a third cylindrical body for reciprocating into, and out of, the power end of a pump, said third cylindrical body having a second inner end with a second helically threaded bore for threadably receiving said second helically threaded pin, and said third cylindrical body also having a second outer end; and, a peripheral flange being affixed to, and extending outwardly from, said second outer end, said peripheral flange being provided with a plurality of holes through which a plurality threaded fasteners are extended for connecting said pony rod to the power end of a pump.

* * * * *